US007159488B2

(12) United States Patent
Soen et al.

(10) Patent No.: US 7,159,488 B2
(45) Date of Patent: Jan. 9, 2007

(54) CORK BOTTLE OPENER

(76) Inventors: Boen Jan Soen, No. G, 29/F, Bi Tao Ge, Hong Hu Bi Hu Park, Luo Hu District, Shenzhen, Guangdong (CN) 518020; Kam Kit Suen, No. G, 29/F, Bi Tao Ge, Hong Hu Bi Hu Park, Luo District, Shenzhen, Guangdong (CN) 518020

( * ) Notice: Subject to any disclaimer, the term of this patent is extended or adjusted under 35 U.S.C. 154(b) by 37 days.

(21) Appl. No.: 11/048,714

(22) Filed: Feb. 3, 2005

(65) Prior Publication Data

US 2005/0199097 A1 Sep. 15, 2005

(30) Foreign Application Priority Data

Mar. 11, 2004 (CN) ..... 2004200436262
Sep. 28, 2004 (CN) ..... 2004200936827

(51) Int. Cl.
*B67B 7/62* (2006.01)
*B67B 7/04* (2006.01)

(52) U.S. Cl. ..... 81/3.2; 81/3.37

(58) Field of Classification Search ..... 81/3.2, 81/3.33, 3.37, 3.29
See application file for complete search history.

(56) References Cited

U.S. PATENT DOCUMENTS 620,949 A * 3/1899 Morgan ..... 81/3.33
776,152 A * 11/1904 Strohacker ..... 81/3.33
814,641 A * 3/1906 Coomber ..... 81/3.33
857,992 A * 6/1907 Gilchrist ..... 81/3.33
4,253,351 A * 3/1981 Allen ..... 81/3.29
4,295,392 A * 10/1981 Peck ..... 81/3.32
6,357,322 B1 * 3/2002 Dolan et al. ..... 81/3.37
D455,058 S * 4/2002 Stirling ..... D8/39
D472,118 S * 3/2003 Kehoe ..... D8/39
6,722,222 B1 * 4/2004 Dolan et al. ..... 74/422
2004/0144210 A1 * 7/2004 Lieberman ..... 81/3.37

* cited by examiner

*Primary Examiner*—David B. Thomas
(74) *Attorney, Agent, or Firm*—Venable LLP; Michael A. Sartori; Steven J. Schwarz

(57) ABSTRACT

A cork bottle opener is disclosed. The cork bottle opener comprises a stand, a clamping element, a cork opening element and a cork removing element. The clamping element holds the bottle neck when the bottle is being opened. Spinning a turning crank drives the cork opening element upwards or downwards. The cork opening element connects to and controls a screw drill through a pair of gears and connecting structures. After the cork is pulled out from the bottle, the cork opening element collaborates with the cork removing element to remove the cork from the screw drill.

5 Claims, 11 Drawing Sheets

CORK BOTTLE OPENER

CROSS-REFERENCE TO RELATED APPLICATIONS

This application claims the priority of Chinese Patent Application No. 200420043626:2, filed Mar. 11, 2004, and Chinese Patent Application No. 200420093682.7, filed Sep. 28, 2004, both of which are hereby incorporated by reference.

FIELD OF THE INVENTION

The invention relates to a tool for opening alcoholic beverage bottles. More particularly, the invention relates to a cork bottle opener.

BACKGROUND OF THE INVENTION

Today, people like alcoholic beverages. High quality alcohol bottles are corked. Conventional cork bottle openers are often based on the lever principle. Because the bottle openers need to be small and exquisite, the lever arms have limited length. Thus, using lever-based bottle openers requires a relatively great force. In addition, removing the cork from opener is often troublesome.

DESCRIPTION OF THE INVENTION

An objective of the invention is to provide a cork bottle opener which is easy, convenient, and requires less force to use.

Another objective of the invention is to provide a cork bottle opener which makes it simple and convenient to remove the cork from the opener after the bottle has been opened.

To achieve the above objectives, the cork bottle opener of the invention comprises four elements: a stand, a cork opening element, a clamping element, and a cork removing element. The clamping element is used to grasp the bottle neck so that the bottle is firmly clasped and cannot move when the cork is being removed. The cork opening element moves along the stand to conveniently pull the cork out of the bottle. The cork removing element collaborates with the cork opening element and detaches the cork from the cork opening element.

The stand consists of a top, a base, a shaft, a screw post, and a turning crank. The top and the base are fixed to the shaft. The screw post is jointed between the top and the base. The turning crank is used to drive the screw post.

The cork opening element includes a moving base. The moving base has three apertures. A side aperture is for the shaft of the stand to pass through. A central aperture is inner-threaded so that it can be attached to the screw post of the stand. The spinning of the screw post drives the moving base between the top and the base of the stand. The other side aperture is for a screw drill to pass through the moving base. A screw drill is connected with the screw post through a pair of gears and connecting structures and it thus follows the screw post to spin.

The clamping element includes a pair of clamps. The clamps hold on the middle of the bottle neck when the bottle is being opened and has a mechanism to tighten the clamps against the bottle neck.

The cork removing element can be a cork removing plate. The plate has three apertures. The shaft and the screw post of the stand and the screw drill of the opening element each passes through an aperture. The plate has ratchets on the down surface around the aperture of the screw drill to prevent the cork from spinning. The two sides of the plate have locks to connect with the base of the stand.

Alternatively, the cork removing element can be a pair of clamps which can hold the cork. This alternative structure is simpler and less of a hassle to use.

As discussed above, the clamping element fastens the opener to the bottle neck, the cork opening element operates to pull the cork out of the bottle, and the cork removing element detaches the cork from the opener. The advantages of the opener of the invention can be further illustrated by the following two embodiments.

EMBODIMENTS

Embodiment 1

Figure 1:
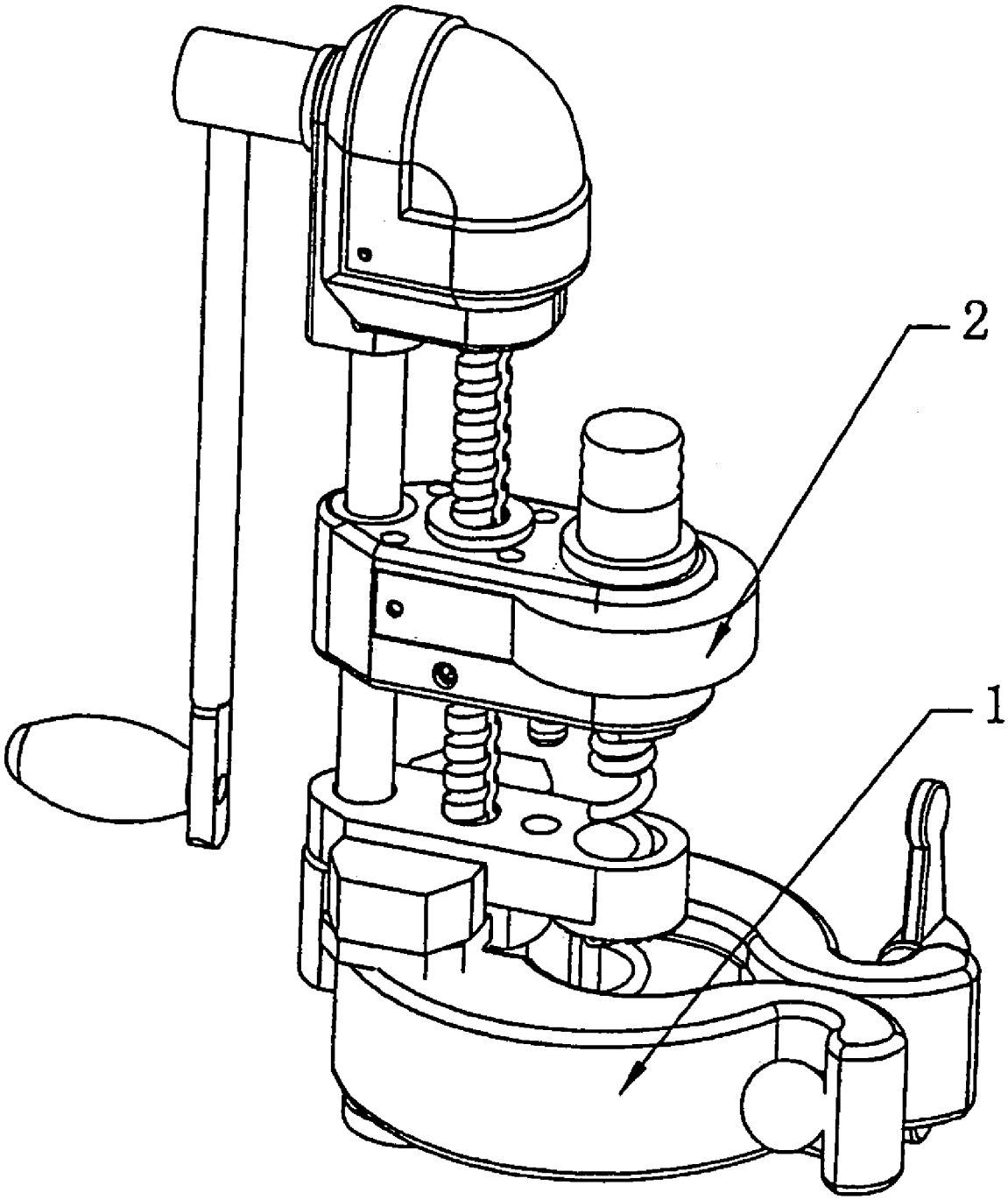
FIG. 1 is a three-dimensional view of the first embodiment of the invention.
Figure 2:
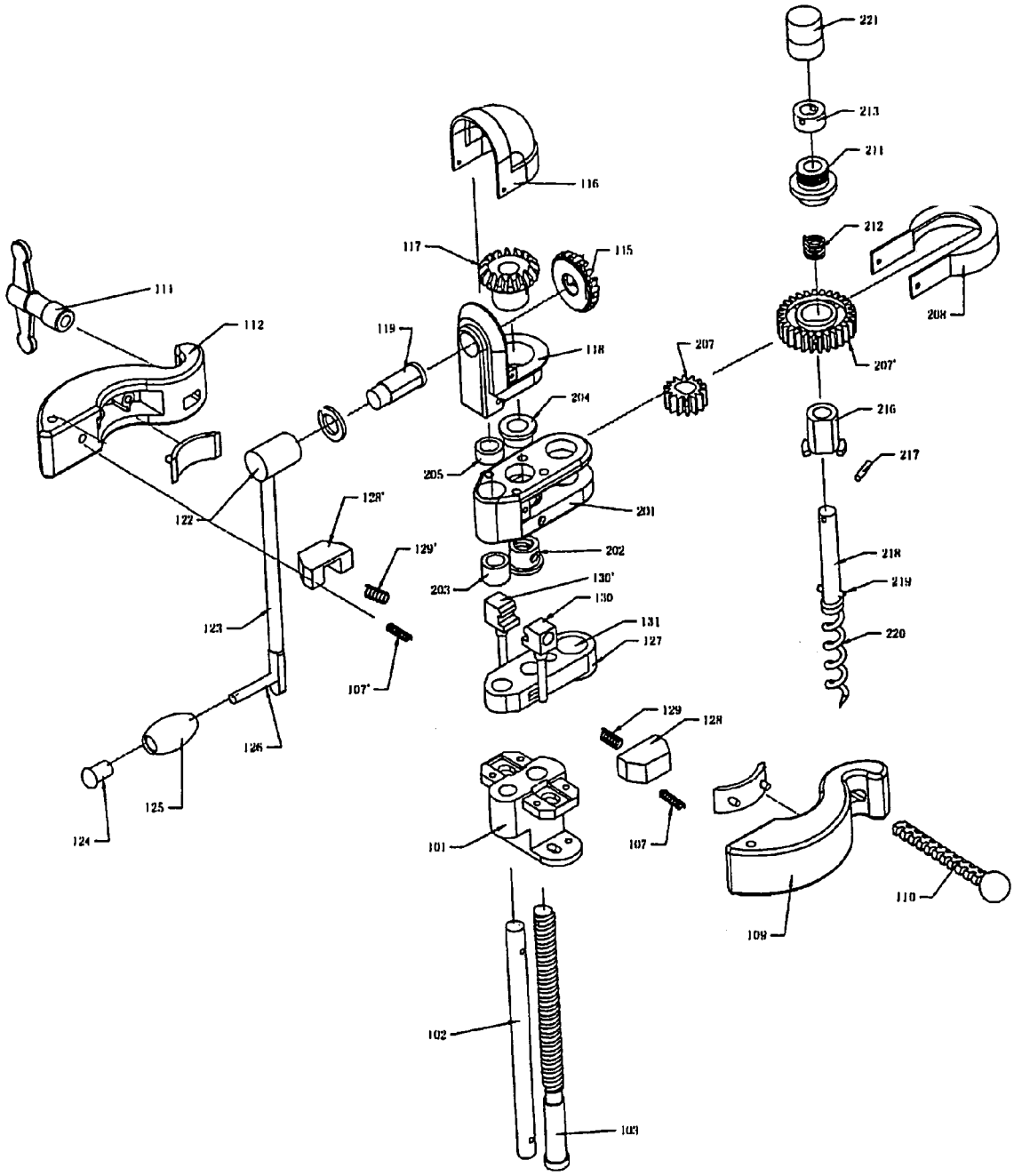
FIG. 2 is a three-dimensional view of the assembly parts of the first embodiment of the invention.
Figure 3:
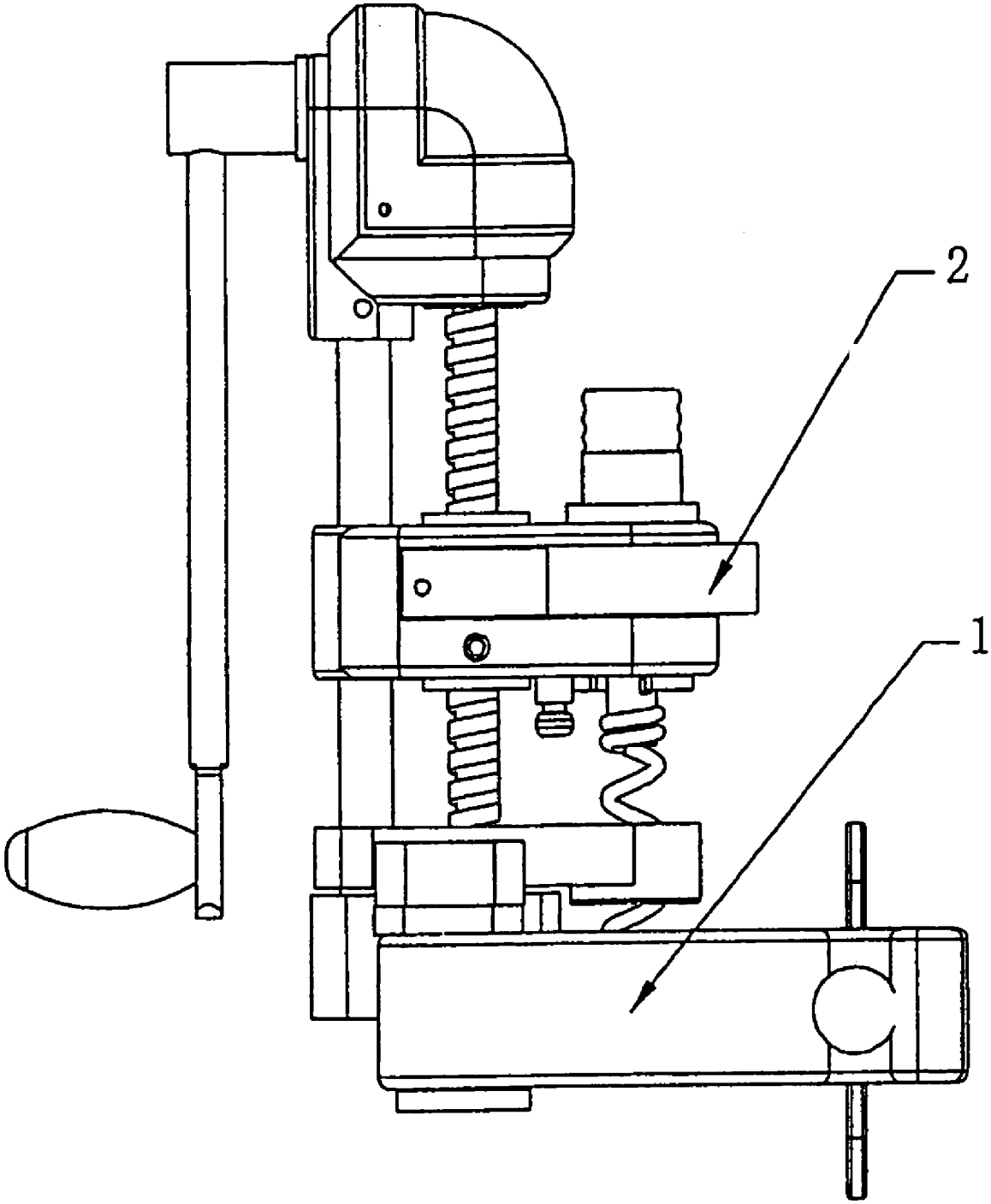
FIG. 3 is a front view of the first embodiment of the invention.
Figure 4:
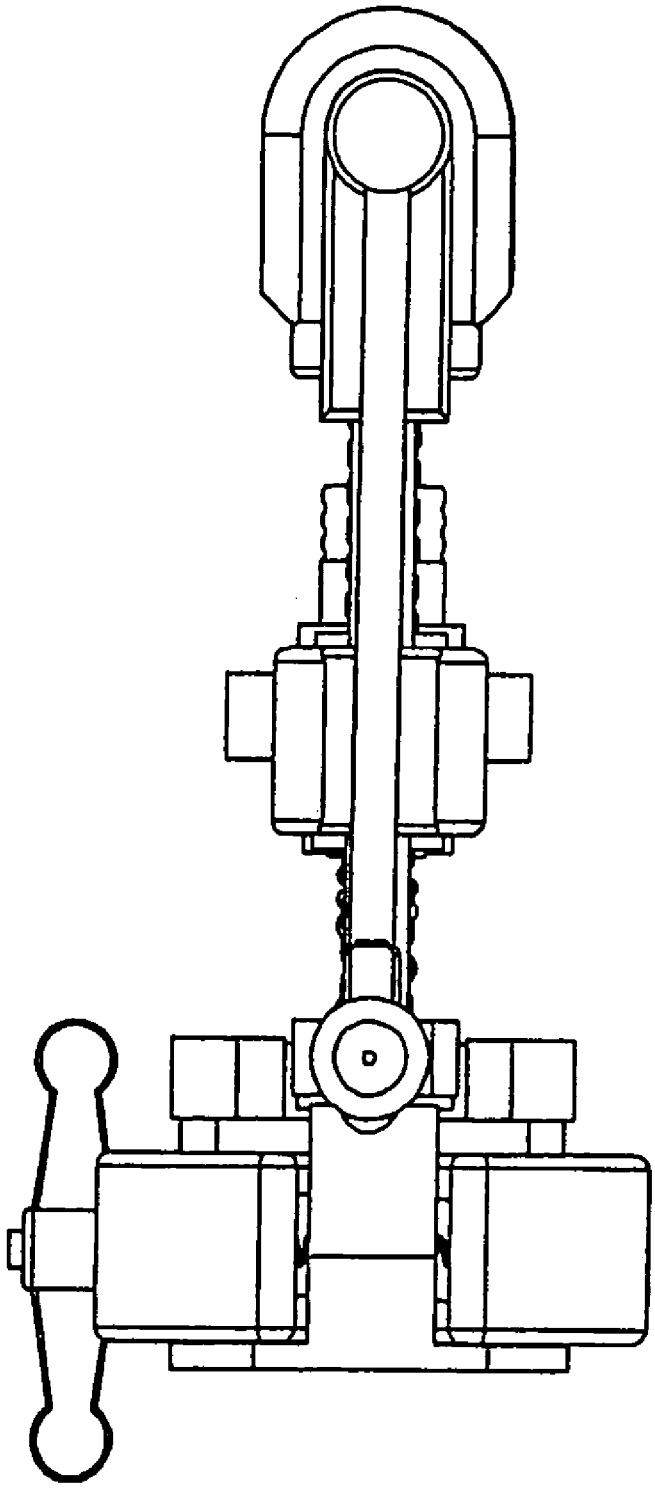
FIG. 4 is a left view of the first embodiment of the invention.
Figure 5:
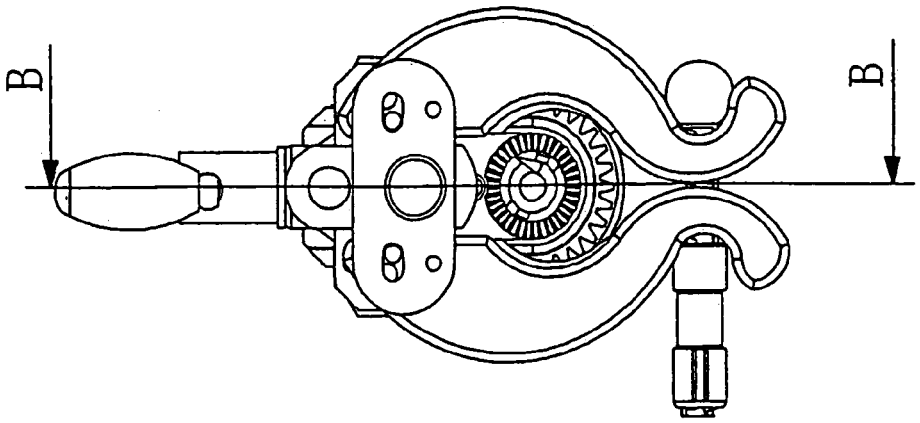
FIG. 5 is an elevation view of the first embodiment of the invention.
Figure 6:
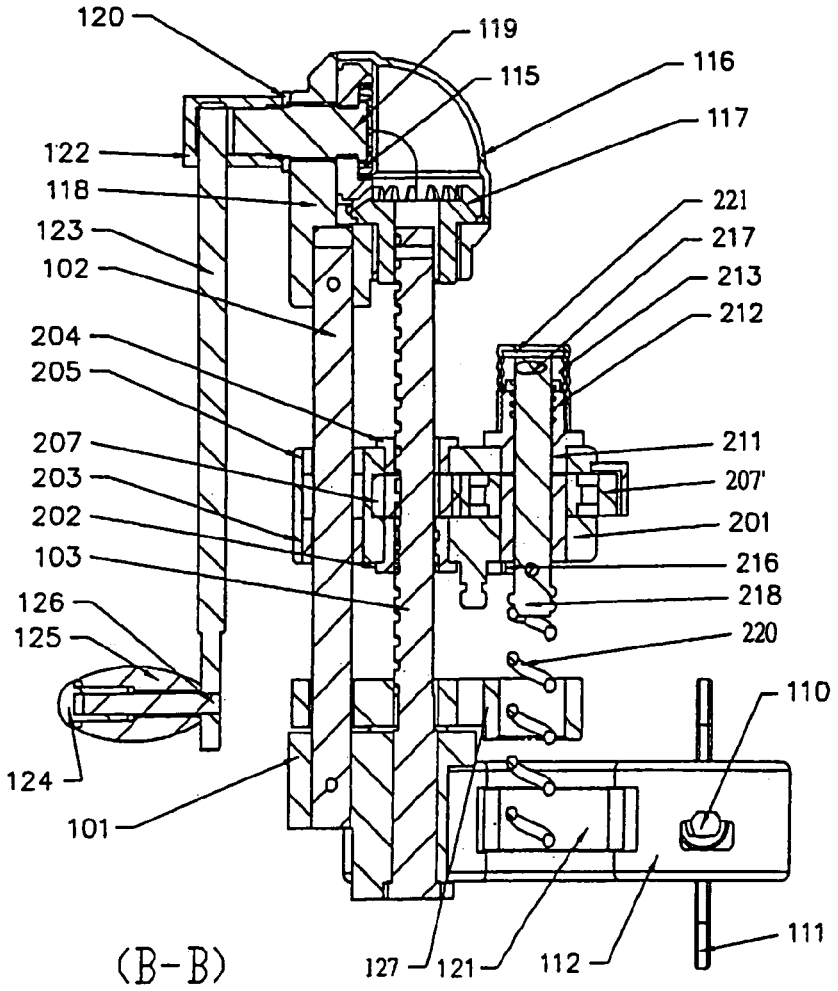
FIG. 6 is a B—B sectional view of FIG. 5.

See FIGS. 1–6. The base 101 and the top 118 are fixed to the shaft 102. The screw post 103 is jointed between the base 101 and the top 118. The top 118 is equipped with a lateral axis 119. The lateral axis 119 is equipped with a bevel gear 115 at the inner end. The bevel gear 115 is connected with a bevel gear 117 which is extended from the screw post 103. The top 118 is equipped with a cover 116. The upper end of lateral axis 119 is connected with shaft 122 which is a part of the Z-shaped turning crank 123. The Z-shaped turning crank 123 is equipped with a handle 125. At the end of shaft 126 there is a nut 124 to prevent the handle 125 from loosening up from the shaft 126. The base 101 is equipped with a pair of clamps 109 and 112. At the edges of clamps 109 and 112 there are a bolt 110 and a nut 111. Two holding bars 128 and 128' are fixed to the upper surface of the base 101. Between the holding bars 128 and 128', there are two movable blocks 130 and 130'. The inwards of moveable blocks 130 and 130' have substantially U-shaped flanges. Between the outer of moveable blocks 130 and 130' and the holding bars 128 and 128' there are springs 129 and 129'. A cork removing plate 127 and cork opening element 2 are attached onto the shaft 102 and the screw post 103. The left end of the cork removing plate 127 is set between the moveable blocks 130 and 130'. On the right end of the cork removing plate 127 there is an aperture 131 which is inner-threaded and has ratchets on the bottom side. The cork opening element 2 is placed above the cork opening element 127. The cork opening element 2 is attached onto the screw post 103 which drives the cork opening element 2 moving upwards or downwards.

The main part of the cork opening element 2 has a substantially U-shaped moving base 201. The central aperture of the moving base 201 is inner-threaded and is jointed with the screw post 103, the axle sleeves 202 and 204. The left aperture of the moving base 201 is jointed with the shaft 102. The right aperture of the moving base 201 is equipped with the axle sleeve 211 and releasable axle sleeve 216. On the bottom of the releasable axle sleeve 216 there are troughs. The outer circle diameter of the troughs is larger than that of the aperture 131. Between the axle sleeves 211 and 216 there is a returning spring 212.

The shaft 218 passes through the axle sleeves 211, the spring 212 and the releasable axle sleeve 216. The releasing pin 219 on the bottom of the shaft 218 can be hooked on the releasable axle sleeve 216 through the trough. The bottom of the shaft 218 is equipped with a screw drill 220. At the top of the shaft 218 there is a locking sleeve 213 which is connected with the shaft 218 through pin 217. The axle sleeve 211 is connected with a nut 221.

In the inner space of the moving base 201, there is a gear 207 which is connected with the screw post 103. In this embodiment, the screw post 103 allows the moving base 201 to move along the axial. The gear 207 coordinates with the aperture and functions as a keyway. The gear 207 is connected with the driven gear 207'. The driven gear 207' is connected to the releasable axle sleeve 216. The mouse of the moving base 201 has a cover 208. The spinning of the screw post 103 drives the gear 207, which then drives the driven gear 207' and the axle sleeve 216.

When the moving base 201 moves downwards and reaches the cork removing plate 127, the releasable axle sleeve 216 is pressed by the cork removing plate 127. The cork removing plate 127 pushes the releasable axle sleeve 216 to move up, which compresses the returning spring 212. The pin 219 is therefore disconnected from the trough of the releasable axle sleeve 216. The shaft 218 and the screw drill 220 are thus separated with the releasable axle sleeve 216, and they stop spinning. When the cork removing plate 127 no longer presses on the releasable axle sleeve, the returning spring 212 pushes the releasable axle sleeve 216 to return to its original position. The pin 219 locks into the trough of the releasable axle sleeve 216. The spinning of the releasable axle sleeve then drive the shaft 219 and the screw drill 200 spin.

The moveable blocks 130 and 130' have bolts which connect to the base 101 and the clamps 109 and 112. The clamps 109 and 112 are made from plastics. Between the clamps 109 and 112 there are springs 107 and 107'. Inside the clamps 109 and 112 there are buffers 121 and 121'. Optionally, the edges of the clamps 109 and 112 can be equipped with "butterfly" openers for opening beer bottles or cans.

The following illustrates how the cork bottle opener of the invention works.

To open a corked bottle, the bottle neck is place between the clamps 109 and 112.

The nut 111 is rotated to tighten the clamps against the bottle neck. The opener is supported onto the bottle. The turning crank 123 is rotated, which, through gears 115 and 117, drives the screw post 103 to spin. The spinning of the screw post 103 then, through its connection of with the axle sleeve 202, drives the cork opening element 2 move downwards. The spinning of the screw post 103 also drives the gear 207 which then drives the driven gear 207' and the releasable axle sleeve 216. The returning spring 212 pushes the pin 219 to lock into the releasable axle sleeve 216. The driven gear 207' and the releasable axle sleeve 216 drive the shaft 218 and the screw drill 220. The screw drill 220 drills. into the cork. Rotating the turning crank 123 continues. The cork opening element 2 presses onto the cork removing plate 127; the reacting force from the removing plate 127. pushes the releasable axle sleeve 216 up to its top position; and the shaft 219 and the releasable axle sleeve 216 become unhooked. The screw drill 220 then stops spinning.

The turning crank 123 is then rotated in the opposite direction, which drives the cork opening element 2 and the crew drill 220 moving upwards. The friction between the cork and the bottle mouse pulls the crew drill 220. The pin 219 remains unlocked from the releasable axle sleeve 216 so that the screw drill 220 does not spin out of the cork. At the same time, the cork generates a relatively large force to push the cork removing plate 127 unlocked from the moveable blocks 130 and 130' and the corking removing plate moves upwards along the shaft 102 to pull the cork out of the bottle. The clamps 109 and 112 are released and the opened bottle away is then taken away. The turning crank 123 is rotated again. The cork opening element 2 and cork removing plate 127 move downwards till the cork removing plate 127 reaches the base 101. Under the force of the springs 129 and 129', the movable blocks 130 and 130' are locked with the cork removing plate 127. The turning crank 123 is rotated in the opposite direction. The cork opening element 2 moves up. Under the force of the returning spring 212, the pin 219 is locked into the releasable axle sleeve. The driven gear 207' and the releasable axle sleeve 216 drive the shaft 218 and the screw drill 220 spin. Because the cork removing plate 127 does not have enough energy to push up and to separate from the base 101, the removing plate 127 blocks the cork from moving up. On the other side, the ratchets of the cork removing element 127 nail the cork and prohibit the cork from spinning with the screw drill 220. As the screw drill 220 continues spinning and moves up along the shaft 102, the screw drill 220 spins out from the cork.

Embodiment 2

Figure 7:
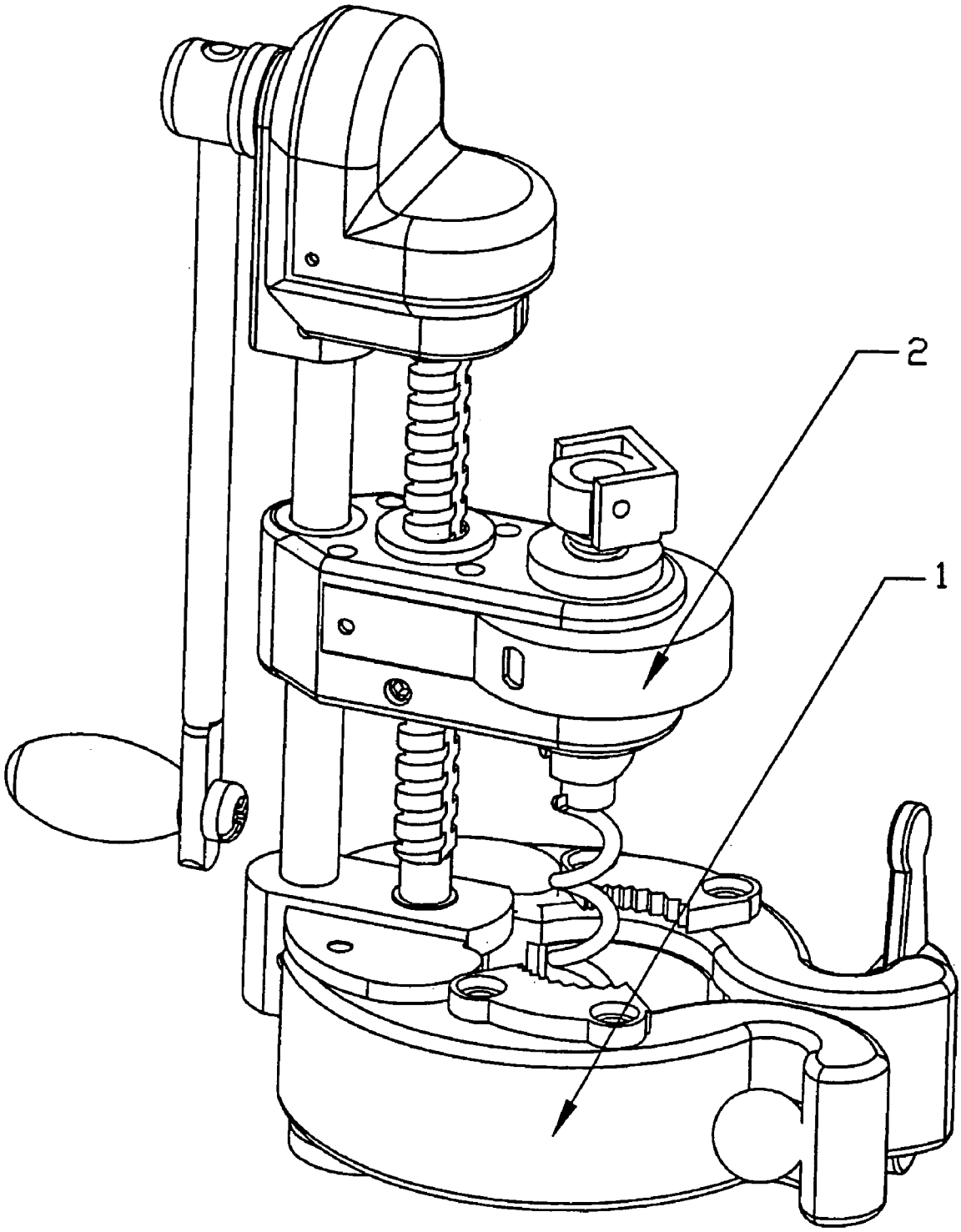
FIG. 7 is a three-dimensional view of the second embodiment of the invention.
Figure 8:
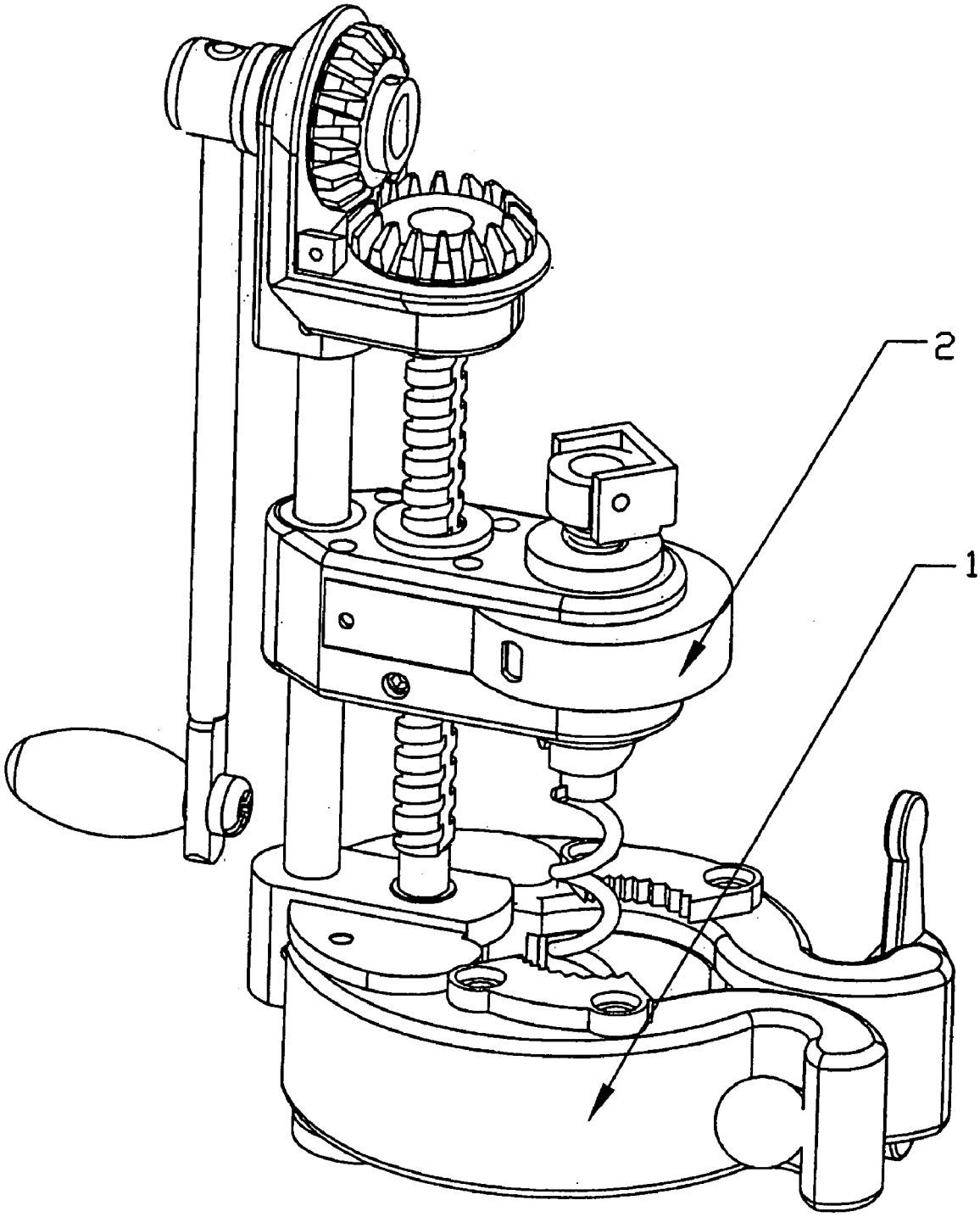
FIG. 8 is a prospective view of the second embodiment with the gear cover open.
Figure 9:
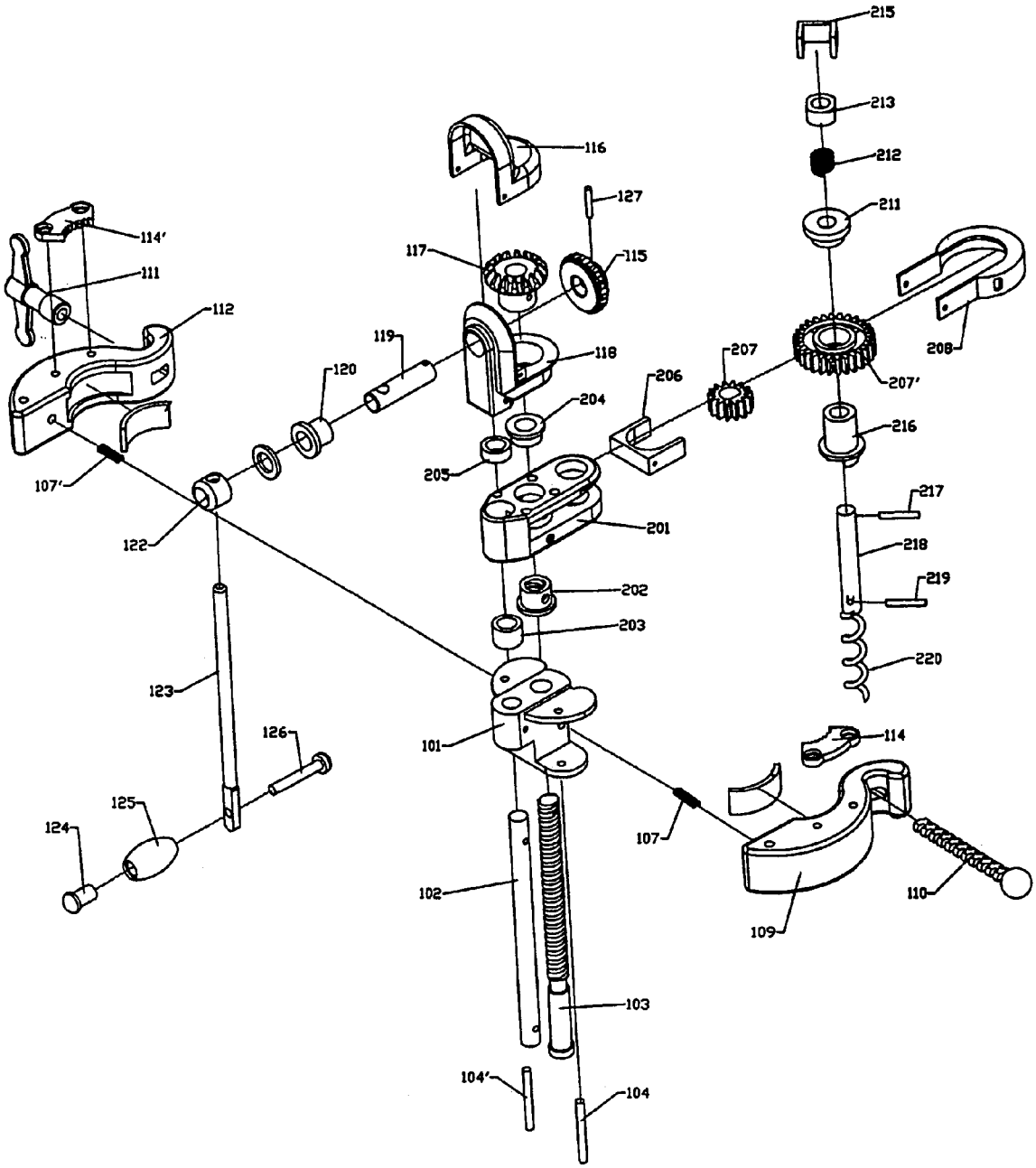
FIG. 9 is. a three-dimensional view of the assembly parts of the second embodiment of the invention.
Figure 10:
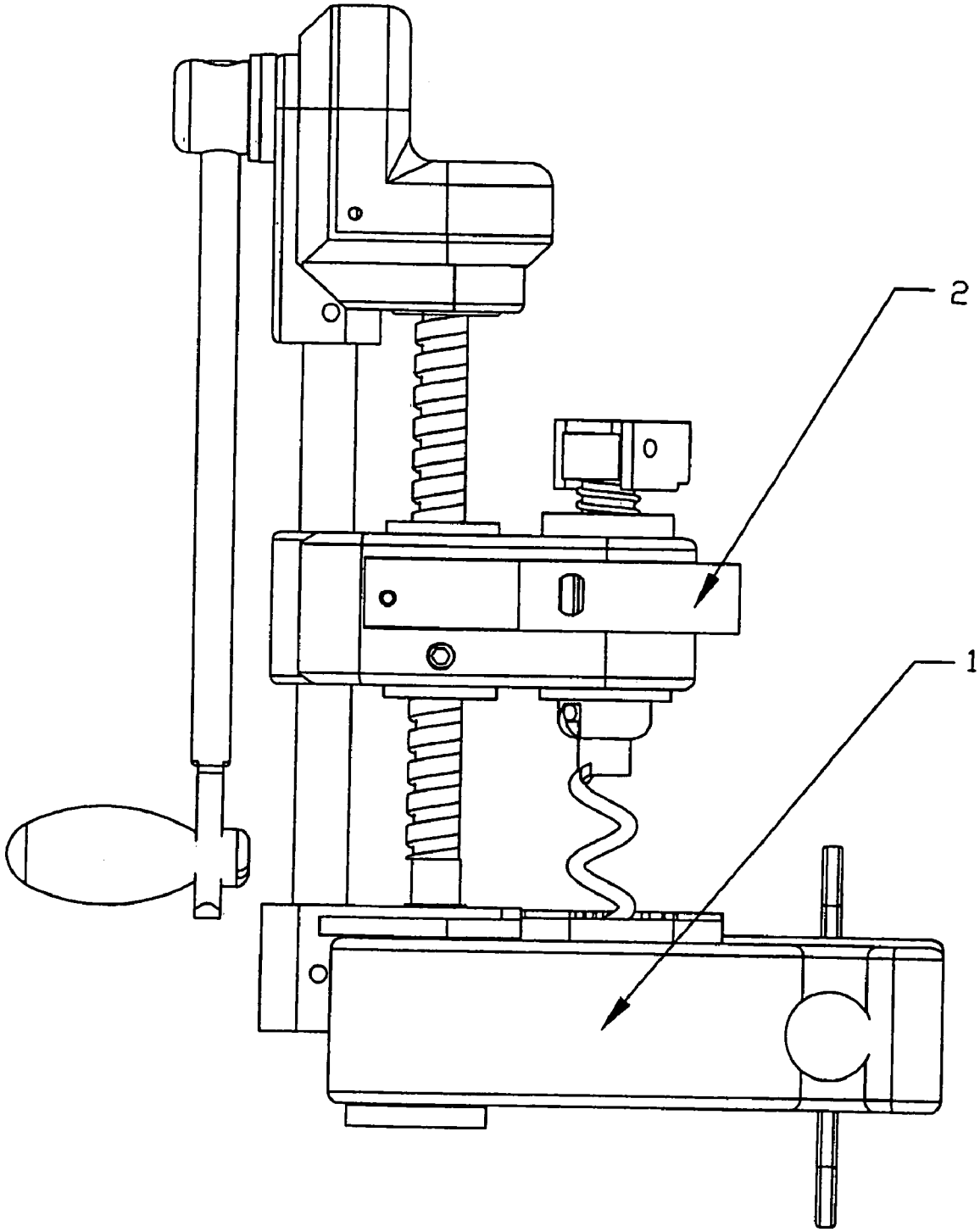
FIG. 10 is a front view of the second embodiment of the invention.
Figure 11:
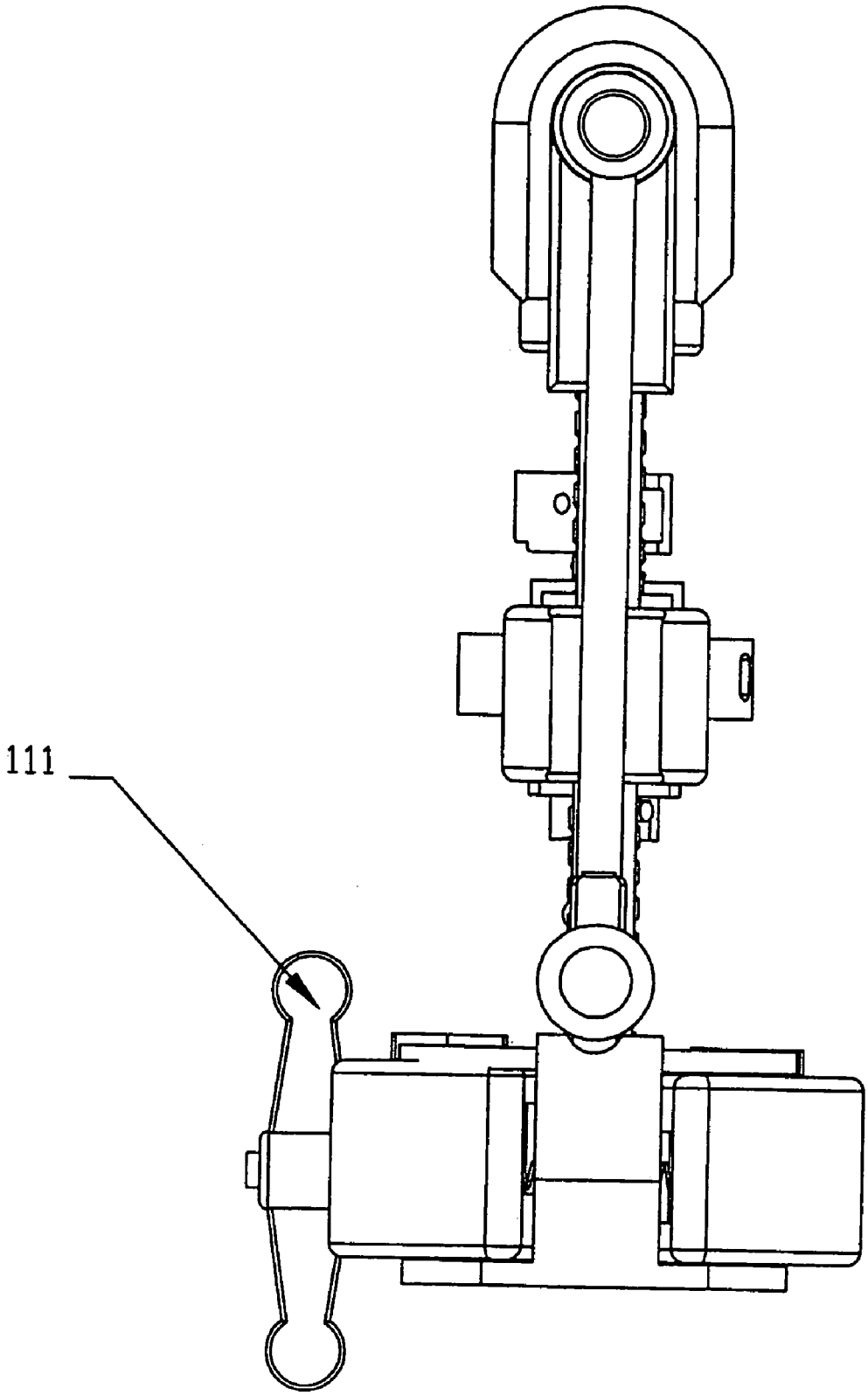
FIG. 11 is a left view of the second embodiment of the invention.
Figure 12:
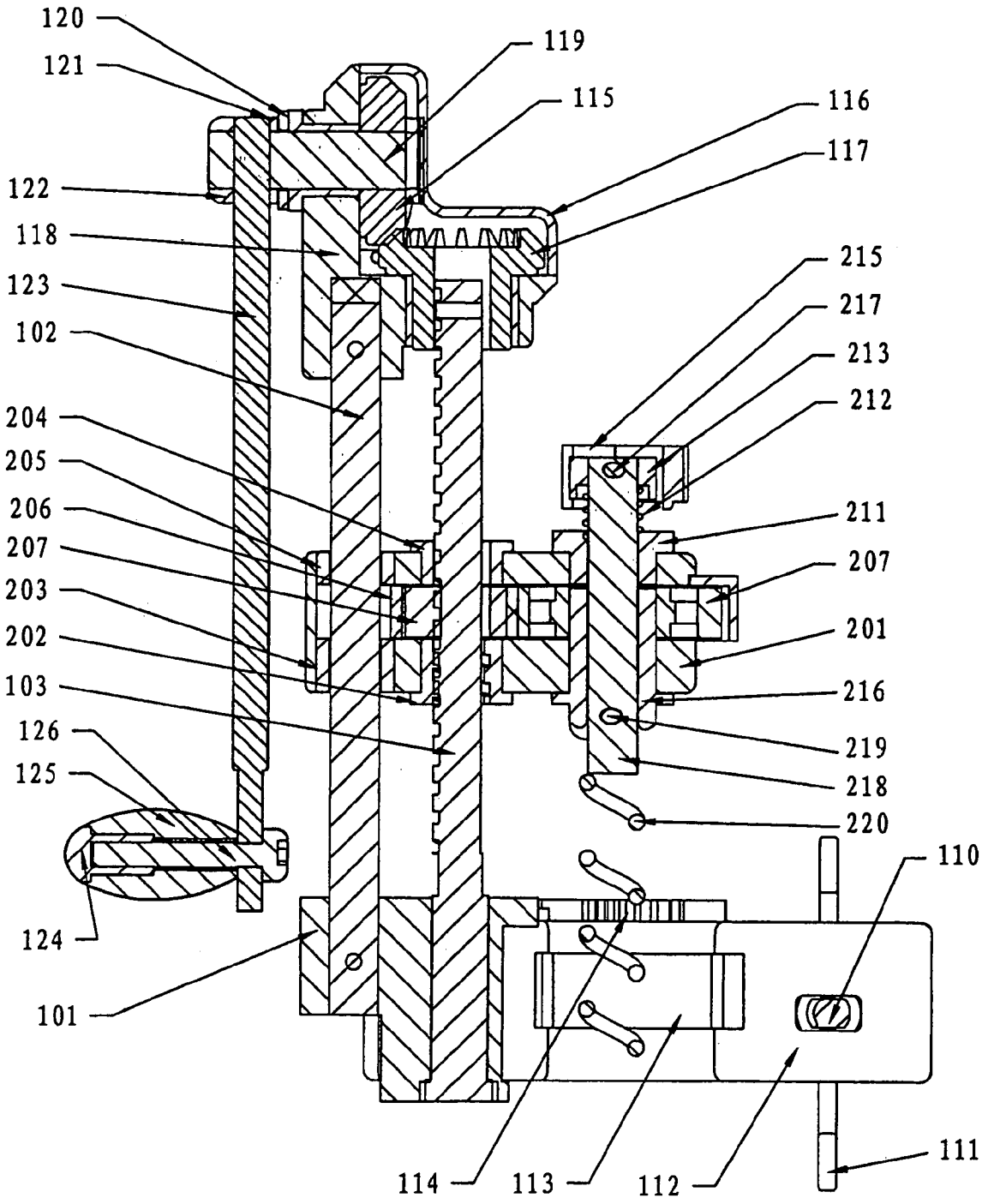
FIG. 12 is a sectional view of the second embodiment along the shaft and the screw post.

See FIGS. 7–12. The same part numbers in this embodiment mean the same as in embodiment 1. They are not repeated here. This embodiment differs from embodiment 1 in the structure of the cork removing element and in the releasing mechanism. These differences are described as follows.

The cork removing element comprises a pair of holding chips 114 and 114' which are equipped on the clamps 109 and 112, respectively. The holding chips 114 and 114' have teeth which can hold the cork. The difference in the releasing mechanism is that the locking sleeve 213 is equipped with a position adjusting cover 215 which connects the locking sleeve 213 to the top of the shaft 218. The position adjusting cover 215 is "⊏" shaped and at the edges of its mouse there are pin holes. The shaft 218 can rotate around the pin 217, positioning vertically or horizontally. It has a pin hole on each side. The two sides press on the top of the axle sleeve 211.

The releasing mechanism is as follows. First, the position adjusting cover 215 is positioned vertically and the turning crank 123 is turned to move the cork opening element 2 downwards. The screw drill 220 therefore spins into the cork. Then, the turning crank is turned in the opposite direction to move the cork opening element upwards. Under the reacting force of the cork, the releasing pin 219 leaves the trough of the releasing axle sleeve 216, which therefore stops spinning. The cork opening element 2 continues moving upwards and pulls the cork out of the bottle. The open bottle is taken away. The cork element 2 is then moved downwards to locate the cork between the holding chips 114 and 114'. The nut 111 is turned to hold the cork tight. The position adjusting cover 215 is then positioned horizontally (see FIG. 7). Thus, due to the increased distance between the pin holes and the side surface, the pin 219 is forced to enter the trough of the releasing axle sleeve 216. The pin 219 keeps spinning till the cork is released.

INDUSTRIAL APPLICABILITY

The cork bottle opener of the invention uses a screw to drive the cork opening element moving upwards and downwards and easily removes the cork from the bottle. Because the cork opening element, the clamping element, and the cork removing element are exquisitely designed and structured, the cork bottle opener of the invention is simple and convenient to use.

We claim:

1. A cork bottle opener comprising:

a stand, which supports other parts of the opener;

a clamping element which is equipped on the bottom of the stand, holds on the bottle neck, and attaches the opener to the bottle when the bottle is being opened;

a cork opening element which moves upwards and downwards to pull the cork out of the bottle; and a cork removing element which locates above the clamping element and below the cork opening element and collaborates with the cork opening element to detach the cork from the opening element;

wherein the stand comprises a top, a base, a shaft, a screw post, and a turning crank; the top and the base are fixed to the shaft; the screw post is jointed between the top and the base; the turning crank is used to drive the screw post to spin;

wherein the cork opening element comprises a moving base which has three apertures, one for the shaft of the stand to pass through, one being inner-threaded and connected with the screw post of the stand, and one for a screw drill to pass through; the screw drill receives spinning power from the screw post through a pair of gears and connecting structures;

wherein the clamping element comprises a pair of clamps which holds on the middle of the bottle neck and has a locking mechanism to tighten the clamps against the bottle neck; and wherein the cork removing element comprises a cork removing plate which has three apertures for the shaft and the screw post of the stand and for the screw drill of the opening element to pass through; the plate has ratchets on the down surface around the aperture of the screw drill to prevent the cork from spinning; the two sides of the plate have locks to connect with the base of the stand.

2. The cork bottle opener of claim 1 wherein the pair of gears consist of a gear which is connected with the screw post and a driven gear; wherein the connecting structures include a releasable axle sleeve which is connected to the driven gear and has troughs on its bottom, a shaft which is extended from the screw drill, a releasing pin which collaborates with the troughs, a returning spring, and a upper axle sleeve; the upper axle sleeve, the returning spring, the releasable axle sleeve in order are limited to and located between a locking sleeve and the releasing pin.

3. The cork bottle opener of claim 2 wherein the outer circle diameter of the releasable axle sleeve trough is larger than the diameter of the screw drill.

4. A cork bottle opener comprising:

a stand, which supports other parts of the opener;

a clamping element which is equipped on the bottom of the stand, holds on the bottle neck, and attaches the opener to the bottle when the bottle is being opened;

a cork opening element which moves upwards and downwards to pull the cork out of the bottle; and a cork removing element which locates above the clamping element and below the cork opening element and collaborates with the cork opening element to detach the cork from the opening element;

wherein the stand comprises a top, a base, a shaft, a screw post, and a turning crank; the top and the base are fixed to the shaft; the screw post is jointed between the top and the base; the turning crank is used to drive the screw post to spin;

wherein the cork opening element comprises a moving base which has three apertures, one for the shaft of the stand to pass through, one being internally threaded and connected with the screw post of the stand, and one for a screw drill to pass through; the screw drill receives spinning power from the screw post through a pair of gears and connecting structures;

wherein the clamping element comprises a pair of clamps which hold on the middle of the bottle neck and has a locking mechanism to tighten the clamps against the bottle neck; and wherein the cork removing element comprises two holding chips which are fixed to a pair of clamps.

5. The cork bottle opener of claim 4 wherein the pair of gears consist of a gear which is connected with the screw post and a driven gear; wherein the connecting structures include a releasable axle sleeve which is connected to the driven gear and has troughs on its bottom, a shaft which is extended from the screw drill, a releasing pin which collaborates with the troughs, a returning spring, and a upper axle sleeve; the upper axle sleeve, the returning spring, the releasable axle sleeve in order are limited to and located between a locking sleeve and the releasing pin.

* * * * *